US009725995B2

(12) United States Patent
Wildman et al.

(10) Patent No.: US 9,725,995 B2
(45) Date of Patent: Aug. 8, 2017

(54) BOTTLE CHAMBER GAS LIFT SYSTEMS, APPARATUSES, AND METHODS THEREOF

(71) Applicant: Lufkin Industries, LLC, Lufkin, TX (US)

(72) Inventors: Samuel Wildman, Kingwood, TX (US); Joseph Glasofer, Houston, TX (US); John McCrady, Burleson, TX (US); Ricardo Lopez, Houston, TX (US)

(73) Assignee: Lufkin Industries, LLC, Lufkin, TX (US)

( * ) Notice: Subject to any disclaimer, the term of this patent is extended or adjusted under 35 U.S.C. 154(b) by 214 days.

(21) Appl. No.: 14/300,374

(22) Filed: Jun. 10, 2014

(65) Prior Publication Data

US 2014/0360732 A1 Dec. 11, 2014

Related U.S. Application Data

(60) Provisional application No. 61/833,723, filed on Jun. 11, 2013.

(51) Int. Cl.
*E21B 43/12* (2006.01)
*E21B 34/00* (2006.01)

(52) U.S. Cl.
CPC ..... *E21B 43/122* (2013.01); *E21B 43/123* (2013.01); *E21B 2034/002* (2013.01)

(58) Field of Classification Search
CPC ..... F04F 1/20; E21B 43/12; E21B 43/122; E21B 43/123; E21B 34/00; E21B 2034/002
See application file for complete search history.

(56) References Cited

U.S. PATENT DOCUMENTS 3,306,313 A * 2/1967 Roach ..... E21B 43/123 137/102
3,675,714 A * 7/1972 Thompson ..... E21B 43/123 137/155

(Continued)

OTHER PUBLICATIONS

Kongdachundomkul, C., et al., "DeepLift—The Innovative Gaslift Bypass Packer Technique", International Petroleum Technology Confererence, IPTC 14760, prepared for IPTC in Thailand Feb. 2012, copyright 2011 by International Petroleum Technology Conference.

(Continued)

*Primary Examiner* — Yong-Suk (Philip) Ro
(74) *Attorney, Agent, or Firm* — Crowe & Dunlevy, P.C.

(57) ABSTRACT

Applicants have created systems, methods, and apparatuses for increasing the production of fluid from a subterranean well. The system can include a controller and upper and lower portions. The upper portion can include an injection valve for regulating the amount of a first gas injected into an injection conduit. The lower portion can include a chamber valve for regulating the flow of a second gas through an upper tubing string and a vent valve for regulating the flow of the first gas and a standing valve. The collected fluid creates pressure in the lower portion causing the second gas to flow from the lower tubing string to the upper tubing string. The controller controls the injection valve and is coupled to a pressure gauge for measuring pressure in the lower portion. With the aid of this system, well operators can increase production of subterranean well formations, such as gas wells, without increasing backpressure on those formations.

3 Claims, 5 Drawing Sheets

(56) References Cited

U.S. PATENT DOCUMENTS

| | | | | |
|---|---|---|---|---|
| 3,680,637 | A * | 8/1972 | Raulins | E21B 23/08 166/313 |
| 4,708,595 | A | 11/1987 | Maloney et al. | |
| 6,237,692 | B1 | 5/2001 | Averhoff | |
| 6,966,366 | B2 | 11/2005 | Rogers, Jr. | |
| 2003/0047316 | A1* | 3/2003 | Bosley | E21B 43/123 166/372 |
| 2009/0229831 | A1 | 9/2009 | Zupanick | |
| 2009/0266554 | A1* | 10/2009 | Wilson | E21B 43/38 166/372 |
| 2011/0278015 | A1* | 11/2011 | Mazzanti | E21B 17/18 166/372 |
| 2012/0125625 | A1* | 5/2012 | Brewer | E21B 43/122 166/372 |

OTHER PUBLICATIONS

"Gas-Well Deliquification Technology", Weatherford, copyright 2010 by Weatherford, [retrieved from the internet on Aug. 4, 2014 using <URL: http://weatherford.com/weatherford/groups/public/documents/weatherforddirect/www019023.pdf>].

* cited by examiner

BOTTLE CHAMBER GAS LIFT SYSTEMS, APPARATUSES, AND METHODS THEREOF

CROSS REFERENCE TO RELATED APPLICATIONS

The present application claims the benefit of and priority to U.S. Provisional Patent Application Ser. No. 61/833,723, filed Jun. 11, 2013, and the contents of which are hereby incorporated by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to gas lift systems, apparatuses, and methods thereof. More specifically, the inventions described herein relate to increasing the production of gas wells through the use of an injection conduit fed bottle chamber of a gas well bore apparatus.

Description of the Related Art

The inventions disclosed and taught herein are directed to an improved system for increasing the production of a gas well. Although these inventions can be used in numerous applications, the inventions will be disclosed in only a few of many applications for illustrative purposes.

Gas lift systems are commonly employed to extract gas, fluids, and/or other natural resources from subterranean wells and other deposits below the Earth's surface. In gas-producing reservoirs, the gas and/or oil contained therein is compressed by the weight of the overlying earth. When the formation is breached by a well, the gas tends to flow into the well under formation pressure. Any other fluid in the formation, such as connate water trapped in the interstices of the sediments at the time the formation was deposited, also moves toward the well. Production of fluids from the well continues as long as the pressure in the well is less than the formation pressure. Eventually, production slows and/or ceases either because formation pressure equals or falls below well pressure (borehole pressure). In the latter case, it has often been found that interstitial water filling the well exerts sufficient pressure to stop or sharply reduce production. A problem arises when the expense of removing the water becomes a substantial portion of, or exceeds the value of the hydrocarbon produced, thereby making it uneconomical to operate the gas and/or oil well. At times, up to 60% of the oil and or gas reserves may remain in the formation.

Many conventional approaches for removing liquid from an oil and gas well are disclosed in the prior art. Piston pumps are common and require either an electric or gas powered motor which is coupled by belts or gears to a reciprocating pump jack. The reciprocating motion of the pump jack, in turn, reciprocates a piston within a cylinder disposed within the well. As the piston reciprocates within the well, valves open and close, creating a low pressure in the well and drawing the oil to the surface. Centrifugal or rotary pumps, often found in water wells, also operate by either an electric or gas powered motor. Usually, the pump is attached directly to the shaft of the motor. The rotary motion of the veins reduces pressure in the well, thereby causing the fluid to flow up the well.

Major disadvantage with both piston and centrifugal pumps include mechanical fatigue and failure of moving parts and high maintenance and repair costs. Furthermore, such systems require large amounts of electricity or fuel to operate, making them more costly than passive systems. Typically, the expense of maintaining and operating such systems will eventually exceed the economic benefits returned and result in the well being shut in with up to 60% of the reserves still within the formation.

In gas producing wells another major disadvantage of conventional pumps such as electrically submersible pumps, is that their efficiency can be very low unless enough hydrostatic head is provided. In gas wells it is often valuable to totally remove the standing fluid to near the bottom of the wellbore where there is simply not enough allowable fluid column height and therefore not enough hydraulic head to allow such pumps to effectively operate. Furthermore, the well accumulation rate of liquids in gas wells can be very much lower than the rate at which such pumps must run which can result in a high frequency of pump shutdown events and an increased risk of such pumps running dry and burning up.

Conventional gas lift systems often require the injection of gases, fluids, or the like—typically under highly pressurized conditions—down the wellbore in order to maximize the yield of the extracted resources. U.S. Pat. No. 4,708,595 to Maloney et al. (hereinafter, "Maloney") illustrates one of these conventional gas lift systems.

Maloney describes an intermittent oil well gas-lift apparatus and process of lifting liquids. The apparatus includes a chamber on the downhole end of a production tubing that is in communication with a sidestring tube in communication with a high pressure gas stored with a casing above and below a packer. A valve in the sidestring permits the entrance of a lifting gas into the chamber to lift the liquid flowing therein to the surface. This increases the pressure differential between the formation and the interior of the casing and lifting chamber during the operation of the apparatus.

Furthermore, U.S. Pat. No. 6,966,366 to Rogers, Jr. (hereinafter, "Rogers") illustrates a modified version of a conventional gas lift system. More specifically, Rogers describes a plunger enhanced chamber lift for well installations and method of retrofitting a well installation to reconfigure it to provide a plunger enhanced lift chamber lift. The wellhead is modified to supply gas under pressure into a secondary annulus and the sealing plug is removed. A check valve is provided and positioned within the coiling tube such that the secondary seal engages the secondary seating nipple. A reciprocally moveable plunger is provided and installed with the coiling tube.

Although both Maloney and Rogers' disclosures teach various implementations of gas lift systems, there are several drawback to their teachings. In particular, these solutions are only effective to varying degrees for various resources to be extracted. For example, these solutions are not effective for extracting coal bed methane, or other gases that exhibit low pressure-to-volume characteristics. Moreover, conventional gas lift systems typically require highly pressurized downhole injections that can increase the back pressure on formations. This back pressure can compromise the integrity of the formation and reduce its overall yield. Finally, conventional gas lift systems typically require large volumes of injection gas and complicated control systems to operate which, as a result, can increase the overall cost of operating the lift.

What is required, therefore, is a solution that provides a gas lift system that can increase the production yield of the formation and decrease its overall cost of operation without increasing the backpressure on the formation.

Accordingly, the inventions disclosed and taught herein are directed to systems, methods, and apparatuses for increasing the production of a gas well that overcome the problems as set forth above

BRIEF SUMMARY OF THE INVENTION

The inventions disclosed and taught herein are directed to systems, methods, and apparatuses for increasing the production of a gas well. The objects described above and other advantages and features of the invention are incorporated in the application as set forth herein, and the associated appendices and drawings.

Applicants have created systems, methods, and apparatuses for increasing the production of a gas well. The system can include a controller and upper and lower portions. The upper portion can include an injection valve for regulating the amount of a first gas injected into an injection conduit. The lower portion can include a chamber valve for regulating the flow of a first gas through an upper tubing string and a vent valve for regulating the flow of the second gas and a standing valve. The collected fluid creates pressure in the lower portion causing the second gas to flow through the annulus to the surface. The controller controls the injection valve and is coupled to a pressure gauge for measuring pressure in the lower portion. With the aid of this system, well operators can increase production of gas well formations without increasing backpressure on those formations.

The apparatus for increasing the production of a gas well can include an upper portion and a lower portion. The upper portion can include an injection valve adapted to regulate the amount of a first gas injected into an injection conduit. The lower portion can include a chamber valve adapted to regulate the flow of a first gas through an upper tubing string and a vent valve adapted to regulate the flow of the second gas through a lower tubing string and a standing valve, wherein the lower portion can be adapted to collect fluid if the standing valve is open. The collected fluid can be further adapted to create pressure in the lower portion to cause the second gas to flow from the lower tubing string to the upper tubing string or through the annulus to the surface.

The apparatus can further include a motor valve wherein the second gas can be adapted to flow through the motor valve and a pressure gauge that can be adapted to measure an amount of pressure in the lower portion. Further, the apparatus can include a crossover adapter to couple the upper and tubing string to the lower portion and one or more mandrels that can be adapted to couple the upper tubing string to a casing that can include one or more perforations, wherein the casing can be adapted to enclose the upper and lower portions.

Still further, the apparatus can include a lower portion crossover adapted to seal the bottom of the lower portion and the lower portion can further include an injection port coupled to the injection conduit. Finally, the standing valve can be located within a landing nipple, the lower tubing string can include one or more perforations, the lower portion of the casing can include one or more perforations, and the lower portion can include a bottle chamber.

The system for increasing the production of a gas well can include an upper portion and a lower portion. The upper portion can include an injection valve adapted to regulate the amount of a first gas injected into an injection conduit. The lower portion can include a chamber valve adapted to regulate the flow of a second gas through an upper tubing string and a vent valve adapted to regulate the flow of the first gas through a lower tubing string and a standing valve, wherein the lower portion can be adapted to collect fluid if the standing valve is open. The collected fluid can be further adapted to create pressure in the lower portion to cause the second gas to flow from the lower tubing string to the upper tubing string. Further, the system can include a controller adapted to control the injection valve and coupled to a pressure gauge adapted to measure an amount of pressure in the lower portion.

The system can further include a motor valve wherein the second gas can be adapted to flow through the motor valve and a pressure gauge that can be adapted to measure an amount of pressure in the lower portion. Further, the system can include a crossover adapter to couple the upper and tubing string to the lower portion and one or more mandrels can be adapted to couple the upper tubing string to a casing that can include one or more perforations, wherein the casing can be adapted to enclose the upper and lower portions.

Still further, the system can include a lower portion crossover adapted to seal the bottom of the lower portion and the lower portion can further include an injection port coupled to the injection conduit. Finally, the standing valve can be located within a landing nipple, the lower tubing string can include one or more perforations, the lower portion of the casing can include one or more perforations, and the lower portion can include a bottle chamber.

The method for increasing the production of a gas well can include the step of increasing an amount of a liquid within a well bore apparatus, wherein the apparatus can include a bottle chamber, a casing, and a lower tubing string, and the step of injecting a first gas through an injection valve when the bottle chamber is filled with the liquid. The method can further include the step of extracting a second gas from the apparatus if a first pressure differential between the casing and the lower tubing string is detected and closing the injection valve if a second pressure differential between the casing and the lower tubing string is detected. The extracting step can further include extracting the liquid from the apparatus through the lower tubing string.

The first pressure differential can include the pressure within the casing as exceeding the pressure within the lower tubing string and the second pressure differential can include the pressure within lower tubing string as exceeding the pressure within the casing. Further, the increasing step can include increasing an amount of liquid in the bottle chamber and the amount of liquid in the bottle chamber can increase if pressure in the casing increases. The method can further include the step of opening a standing valve if a first pressure differential between the casing and the lower tubing string is detected.

The increasing step can further include increasing the amount of liquid within the lower tubing string through one or more perforations in the lower tubing string and entraining the second gas if an increased pressure in the bottle chamber is detected. The second gas can be adapted to flow through a vent valve to the surface. The method can further include the step of closing a standing valve if a first pressure differential between the casing and the lower tubing string is detected, the step of opening a chamber valve, the step of opening an injection valve, the step of closing a chamber valve, and the step of closing a vent valve.

Definitions

The following definitions and explanations are meant and intended to be controlling in any future construction unless clearly and unambiguously modified in the following Description or when application of the meaning renders any construction meaningless or essentially meaningless. In cases where the construction of the term would render it meaningless or essentially meaningless, the definition should be taken from Webster's Dictionary, 3rd Edition. Definitions and/or interpretations should not be incorporated from other patent applications, patents, or publications, related or not, unless specifically stated in this specification or if the incorporation is necessary for maintaining validity.

As used herein, the term "downhole" means and refers to a location within a borehole and/or a wellbore. The borehole and/or wellbore can be vertical, horizontal or any angle in between.

As used herein, the term "uphole" means and refers to a location towards the surface, or origin of a borehole and/or wellbore. The borehole and/or wellbore can be vertical, horizontal or any angle in between.

As used herein, the term "borehole" means and refers to a hole drilled into a subterranean formation.

As used herein, the term "annulus" refers to any void space in an oil well between any piping, tubing or casing and the piping, tubing or casing immediately surrounding it. The presence of an annulus gives the ability to circulate fluid in the well, provided that excess drill cuttings have not accumulated in the annulus preventing fluid movement and possibly sticking the pipe in the borehole.

As used herein, the term "valve" means and refers to any valve or valving means, including, but not limited to flow regulating valves, temperature regulating valves, automatic process control valves, anti-vacuum valves, blow down valves, bulkhead valves, free ball valves, fusible link or fire valves, hydraulic valves, jet dispersal valve, penstock, plate valves, radiator valves, reverse-flow control valves or gates, rotary slide valve, rotary valve, solenoid valve, spectacle eye valve, standing valve, thermostatic mixing valve, throttle valve, globe valve, one-way or two way check valves, one way or two way pressure relief valves, vent valves, combinations of the aforesaid, and/or the like.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1A:
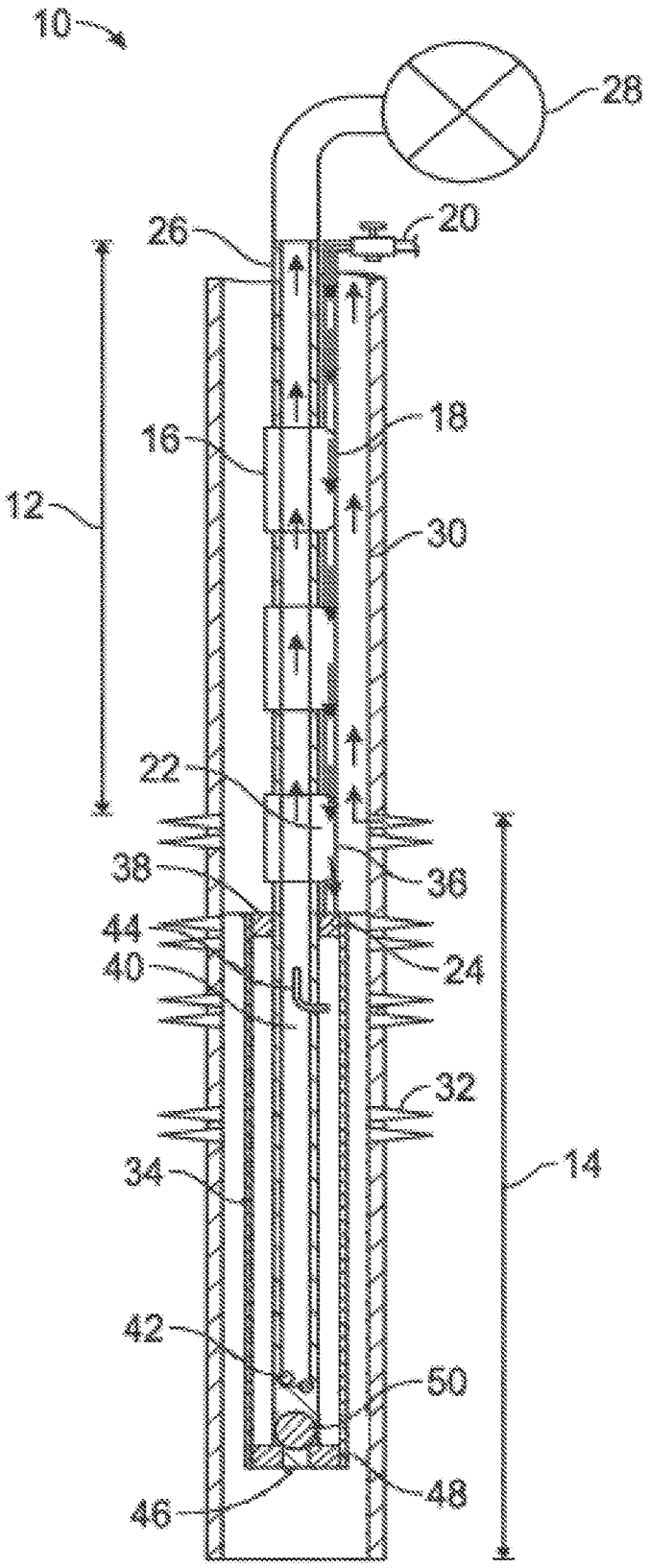
FIG. 1A illustrates a first embodiment of an exemplary apparatus for increasing the production of a gas well.

While the inventions disclosed herein are susceptible to various modifications and alternative forms, only a few specific embodiments have been shown by way of example in the drawings and are described in detail below. The Figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The Figures described above and the written description of specific structures and functions below are not presented to limit the scope of what Applicants have invented or the scope of the appended claims. Rather, the Figures and written description are provided to teach any person skilled in the art to make and use the invention for which patent protection is sought.

Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally.

The term "detected" (or variations thereof, such as, for example, detecting, detection, etc.)—when used in conjunction with pressures and pressure differentials (e.g., "a first pressure differential between the casing and the lower tubing string is detected")—is used broadly throughout the disclosure to include the measured pressure and/or pressure differential (e.g., using a pressure gauge to measure pressure), or pressure that is determined, calculated, or experienced by, or exerted on, a particular element of described inventions. For example, the one or more of the valves described through the disclosure can move from an opened (e.g., first position) to closed position (e.g., second position) (or vice-versa) as a result of the pressure exerted on it. In this regard, the valve can be actuated from a first position to a second position as a result of the pressure and, thus, the "detected" pressure can include at least the amount of pressure required to actuate the valve from this first position to the second position.

Applicants have created systems, methods, and apparatuses for increasing the production of a gas well. The system can include a controller and upper and lower portions. The upper portion can include an injection valve for regulating the amount of a first gas injected into an injection conduit. The lower portion can include a chamber valve for regulating the flow of a second gas through an upper tubing string and a vent valve for regulating the flow of the first gas and a standing valve. The collected fluid creates pressure in the lower portion causing the second gas to flow through the annulus to the surface. The controller controls the injection valve and is coupled to a pressure gauge for measuring pressure in the lower portion. With the aid of this system, well operators can increase production of gas well formations without increasing backpressure on those formations.

Figure 1B:
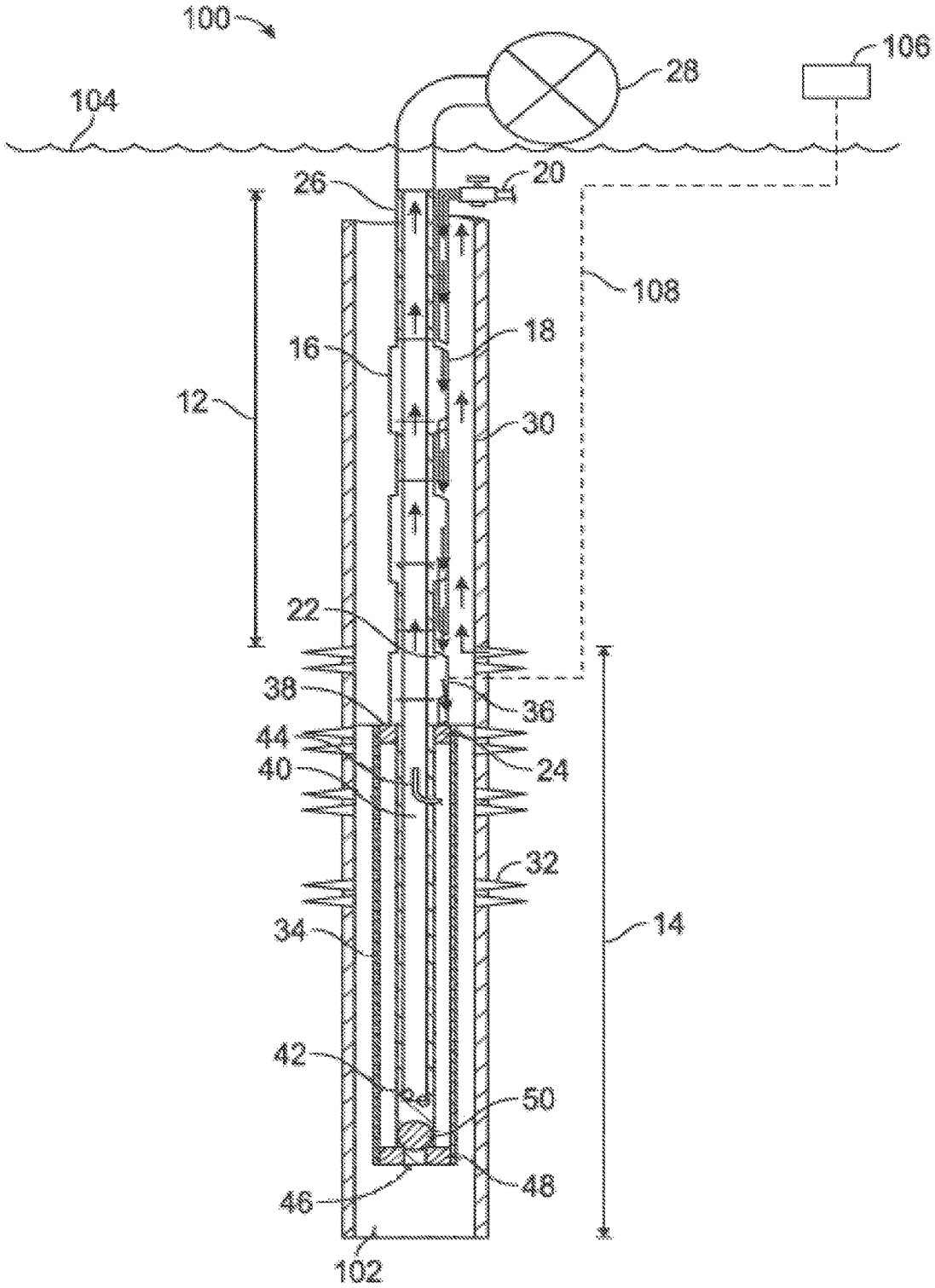
FIG. 1B illustrates a first embodiment of an exemplary system for increasing the production of a gas well.

Turning now to the Figures, FIG. 1A illustrates a first embodiment of an exemplary apparatus for increasing the production of a gas well. FIG. 1B illustrates a first embodiment of an exemplary system for increasing the production of a gas well. These Figures will be described in conjunction with one another.

The apparatus 10 for increasing the production of a gas well can include an upper portion 12 and a lower portion 14. The upper portion 12 can include one or more mandrels 16, an injection conduit 18, and an injection valve 20 adapted to regulate the amount of a first gas injected into an injection conduit 18. Further, lower portion 14 can include a chamber valve 22 adapted to regulate the flow of a first gas through an upper tubing string 26 that can be coupled to motor valve 28. One or more of these elements can be enclosed by casing 30.

More specifically, upper tubing string 26 can be coupled to casing 30 with the aid of the one or more mandrels 16. The one or more mandrels 16 can include any clamp, clip, support, shaft, or other tool for mounting, coupling, and/or affixing the upper tubing string 26 to casing 30. For example, the one or more mandrels 16 can include side pocket mandrels disposed at various locations and/or elevations along upper tubing string 26 (i.e., lift elevations). In one example, the one or more mandrels 16 can be disposed on the upper tubing string 26 (i.e., no farther down upper tubing string 26 than the one or more casing perforations 32 and at uniform intervals along upper tubing string 26).

In another example, the lowest mandrel 16 can be disposed at a location below the one or more casing perforations 32. Moreover, a pressure transducer (not shown) can be disposed at or near one of the mandrels 16 (preferable one of the lower mandrels, proximate to the one or more casing perforations 32). This pressure transducer (not shown) can facilitate in actuating the one or more valves (e.g., vent valve 44, chamber valve 22, etc.) as described in greater detail below. Further, bottle chamber 34 can be disposed below the final mandrel 16, as described in greater detail below.

The upper tubing string 26 can include any tube, string, conduit, pipe, or the like for permitting the flow of a fluid, such as a liquid or gas, from a first location to a second location. For example, tubing can be a cylindrical pipe (e.g., a 3½" diameter tubing), although other diameters are contemplated as well. In addition to supporting the upper tubing string 26, the one or more mandrels 16 can be used to support the injection conduit 18. Injection conduit 18 can include any tube, pipe, string, or the like for permitting the flow of a first gas from injection valve 20 through to injection port 24. The first gas can include an injection gas that can be injected at a particular time or based on a particular event (e.g., pressure differentials detected within apparatus 10), as described in greater detail below in connection with FIG. 2.

Injection valve 20 can include any device, mechanism, or the like for regulating the flow of an injection fluid (such as a liquid or a gas). For example, injection valve 20 can function as a simple actuated switch that can be disposed in "open" and "closed" positions. While disposed in the open position, the flow of the fluid (such as a first gas) can pass through the injection valve 20 and into the injection conduit, thereby increasing the pressure in apparatus 10.

To increase the pressure, injection fluid can pass into lower portion 14 through the injection port 24. Injection port 24 can include any inlet, or other orifice, aperture, or the like for permitting the flow of a fluid from the upper portion 12 (such as the injection conduit 18) to the lower portion 14. In order to terminate the flow of the fluid through injection valve 20, it may be turned to the "closed" position. By doing so, the port that permitted the flow of the fluid through the injection valve 20 can be closed and the flow of fluid will stop.

Similarly, chamber valve 22 can include any device, mechanism, or the like for regulating the flow of an injection fluid (such as a liquid or a gas). For example, chamber valve 22 can function as a simple actuated switch that can be disposed in "open" and "closed" positions. While disposed in the open position, the flow of the fluid (such as a first gas) can pass through lower tubing string 40 to chamber valve 22 and into upper tubing string 16 and upward to surface 104 through motor valve 24. Similarly, as described above with reference to the injection valve 20, in order to restrict or terminate the flow of a fluid (such as a liquid, produced gas, or the like) between the lower tubing string 40 and the upper tubing string 26, the chamber valve 22 can be turned to the closed position. With chamber valve 22 closed, fluid cannot flow from the lower portion 14 of apparatus 10 to the surface 104 even if motor valve 28 is in its opened position.

Motor valve 28 can include any device, mechanism, or the like for regulating the flow of an injection fluid (such as a liquid or a gas). In one example, when motor valve 28 is in its "open" position, the valve can permit the flow of a second gas, such as the gas produced from the formation, and into a gathering system (not shown). In other words, chamber valve 22 and motor valve 28 can be used to permit and/or restrict the flow of the formation gas from the formation (such as gas coalescing at or near well annulus 102, to surface 104).

Casing 30 can include a conventional casing employed for the extraction of gas in gas well formations. For example, casing 30 can include a conduit, tube, pipe, or the like for enclosing upper tubing string 26 (and other elements of FIGS. 1A and 1B as well). Using the example of a 3½" diameter tubing for upper tubing string 26, casing 30 can include a 7" tube, although other diameters are contemplated as well.

Casing 30 can additionally include one or more casing perforations 32 (such as openings, cutaways, slits, slots, or the like disposed on or about various locations of casing 30 used to permit the flow of a fluid, such as a liquid and/or gas through the inner and outer surfaces of casing 30). In one example, the one or more casing perforations 32 can be disposed below the upper portion 12 of apparatus 30. Further, casing 30 can enclose the lower portion 14 (and its respective elements) of apparatus 10 as well.

Lower portion 14 can include bottle chamber 34, pressure gauge 36, lower tubing string 40, and crossover adapter 38. Crossover adapter 38 can include interface for coupling, attaching, connecting, or the like the upper tubing string 26 to bottle chamber 34 and lower tubing string 40. For example, crossover adapter 38 can include a joint, coupler, connector, etc. for permitting one or more of the upper tubing string 26, the bottle chamber 34, lower tubing string 40, and an intermediate tubing (not shown) to be in fluid connection with one another. This intermediate tubing (not shown) can be used as walls of bottle chamber 34. Bottle chamber 34 may be created by enclosing a section of the casing 30 or a section of the intermediate tubing (not shown).

Crossover adapter 38 can, in one example, couple a larger sized tubing string (such as lower tubing string 40 to a smaller tubing string 26). In the example discussed above, the upper tubing string 36 can be 3½" diameter tubing and lower tubing string 40 can be 5½" diameter tubing to allow for a greater flow of fluid through lower tubing string 40. Other diameters from upper tubing string 26 and lower tubing string 40 are contemplated as well.

Lower tubing string 40 can be similarly embodied as the upper tubing string 26 as described above (i.e., a tube, conduit, or the like for permitting the flow of a fluid from one location to another) with a few differences. For example, all or a portion of the lower tubing string 40 can include one or more lower tubing string perforations 42. These perforations 42 can include any slit, slot, hole, annulus, etc. for permitting the flow of a fluid (such as a liquid or gas) between the inner and outer surfaces of the lower tubing string 40. This process is described in greater detail below in conjunction with FIG. 2.

Crossover adapter 38 can be employed as a cap, cover, etc. for bottle chamber 34. For example, crossover adapter 38 can seal (e.g., mechanically with the aid of sealants, gaskets, or the like) the bottle chamber 34. By acting as a seal, the crossover adapter 38 can form a liquid- and/or gas-tight seal in the bottle chamber 34. In another example, crossover adapter 38 can be used in conjunction with the injection port 24, as described in greater detail above, for permitting the injection gas flow through the injection valve 20 and injection conduit 18 and into the bottle chamber 34.

Bottle chamber 34 can further include a vent valve 44 adapted to regulate the flow of the first gas through a lower tubing string 40 and a standing valve 46, such that the lower portion 14 can be adapted to collect fluid (such as liquid) if the standing valve 46 is open. The collected fluid can be further adapted to create pressure in the lower portion to cause the second gas to flow from the lower tubing string 40 to the upper tubing string 26. The standing valve 46 can be located in landing nipple 48.

Vent valve 44 and standing valve 46 can be similarly embodied as the valves described above (e.g., injection valve 20, chamber valve 24, etc.). For example, vent valve 44 can include an electronically controlled valve that can be either disposed in an open or closed position. When in the opened position, vent valve 44 can vent fluids, such as gases originating from the well formation and/or other portions of apparatus 10. The vent valve 44 can be employed, in one example, to regulate the pressure within particular elements of apparatus 10. When vent valve 44 is in a closed positioned, the fluids will not be able to pass from the lower portion 14 to the upper portion 12 and, thus, pressure in the apparatus will increase as described in greater detail below in conjunction with FIG. 2.

Similarly, standing valve 46 can include a mechanically-controlled valve adapted to regulate the amount of a liquid that can flow into bottle chamber 34 as described in greater detail below in conjunction with FIG. 2. For example, if standing valve 46 is open, liquid collected in the well annulus 102 can be drawn into bottle chamber 34 through standing valve 46. Similarly, the flow of this liquid can be terminated when standing valve 46 is closed, as described in greater detail below in conjunction with FIG. 2.

Standing valve 46 can be further disposed proximate to lower portion crossover 50. Lower portion crossover 50 can include any cap, cover, etc. for the lower portion 14. For example, lower portion crossover 50 can seal (e.g., mechanically with the aid of sealants, gaskets, or the like) the lower portion 14. By acting as a seal, the lower portion crossover 50 can form a bottom cap for apparatus 10. In particular examples, lower portion crossover 50 can include a packer and/or threaded mechanism such as conventional crossover type device.

The system 100 for increasing the production of a gas well can further include a controller 106 and first connection 108. Controller 106 can be part of a computer, logic unit, Arithmetic Logic Unit (ALU), or the like for performing one or more the following: inputting information, outputting information, processing information, and storing information. For example controller 106 can include a computer (not shown) or a programmable microprocessor located on the surface 102 for communicating with and operating an actuator, such as pressure gauge 36. In other example, controller 106 can communicate with other elements of system 100 as well, such as the pressure transducer (not shown) or one or more of the valves (e.g., injection valve 20, chamber valve 22, motor valve 28, vent valve 44, standing valve 46, etc.).

Using the example of the controller 106 communicating with pressure gauge 36, the gauge 36 can include any instrument or other measuring device for measuring and/or outputting absolute and/or relative pressure measurements within or about various components of system 100 as described in greater detail below in conjunction with FIG. 2. For example, pressure gauge 36 can include an instrument that is adapted to output data and/or information to controller 106 through first connection 108 to signal when particular pressure and/or pressure differential is detected. Furthermore, pressure gauge 36 can include the fill gauge (not shown) as described above to signal to the controller 106 when the bottle chamber 34 is full.

First connection 108 can include one or more wireless (e.g., RF, WiFi, cellular signals, or the like) or wired configurations. In the example where the controller 106 is part of a computer (not shown), the computer can include an application (not shown), such software, firmware, or other computer readable instructions. The application can include instructions for various operations of the system 100 and apparatus 10 as specifically described in conjunction with FIG. 2. In other words, the instructions can execute one or more of the steps described in conjunction with FIG. 2, below. The application can include any instructions that can be performed or executed by a computer or processing unit. The application can include executable, non-executable, assembly, machine, compiled, or uncompiled code, or any other instructions that can be read by a computer.

Furthermore, the computer (not shown) can include a computer readable medium (not shown) that can include any storage medium that may be used in conjunction with the application or other computer readable instructions. In an exemplary and non-limiting illustrative embodiment, the computer readable medium can include a computer readable storage medium. The computer readable storage medium can take many forms, including, but not limited to, non-volatile media and volatile media, floppy disks, flexible disks, hard disks, magnetic tape, other magnetic media, CD-ROMs, DVDs, or any other optical storage medium, or the like. Computer readable storage media can further include RAM, PROM, EPROM, EEPROM, FLASH, combinations thereof (e.g., PROM EPROM), or any other memory chip or cartridge.

The computer readable medium can further include computer readable transmission media. Such transmission media can include coaxial cables, copper wire and fiber optics. Transmission media may also take the form of acoustic or light waves, such as those generated during radio frequency, infrared, wireless, or other media comprising electric, magnetic, or electromagnetic waves.

Although the particular embodiments illustrated in FIGS. 1A and 1B depict some elements as defining upper portion 12 and other elements defining lower portion 14, other embodiments not explicitly illustrated, are contemplated as well.

Figure 2:
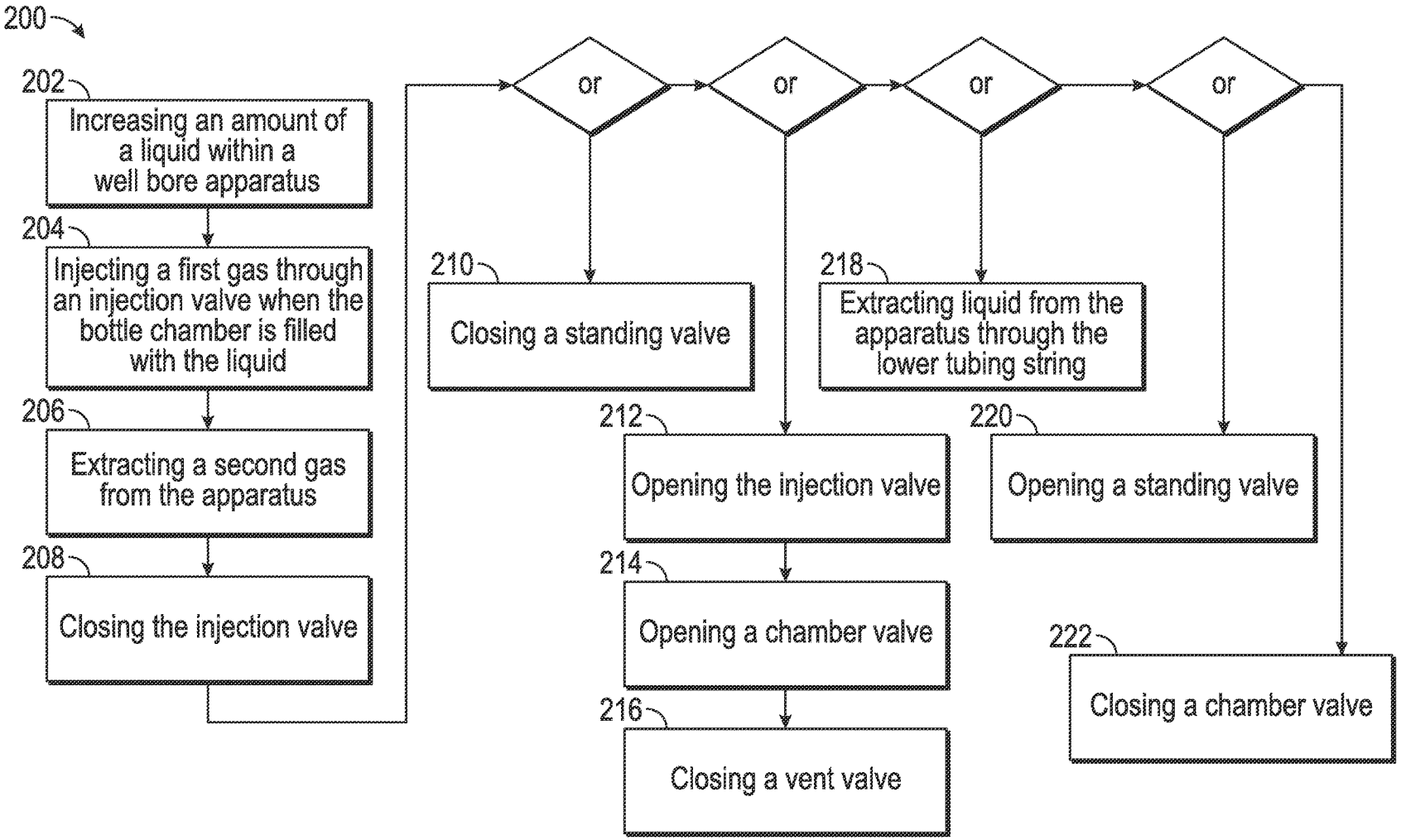
FIG. 2 illustrates a flow diagram depicting an exemplary method for increasing the production of a gas well.

FIG. 2 illustrates a flow diagram depicting an exemplary method for increasing the production of a gas well. The method 200 for increasing the production of a gas well can include the step 202 of increasing an amount of a liquid within a well bore apparatus, wherein the apparatus can include a bottle chamber, a casing, and a lower tubing string, and the step 204 of injecting a first gas through an injection valve when the bottle chamber is filled with the liquid. The method can further include the step 206 of extracting a second gas from the apparatus if a first pressure differential between the casing and the lower tubing string is detected and the step 208 of closing the injection valve if a second pressure differential between the casing and the lower tubing string is detected. The second pressure differential can include the pressure within lower tubing string 40 as exceeding the pressure within the casing 30.

Figure 3A:
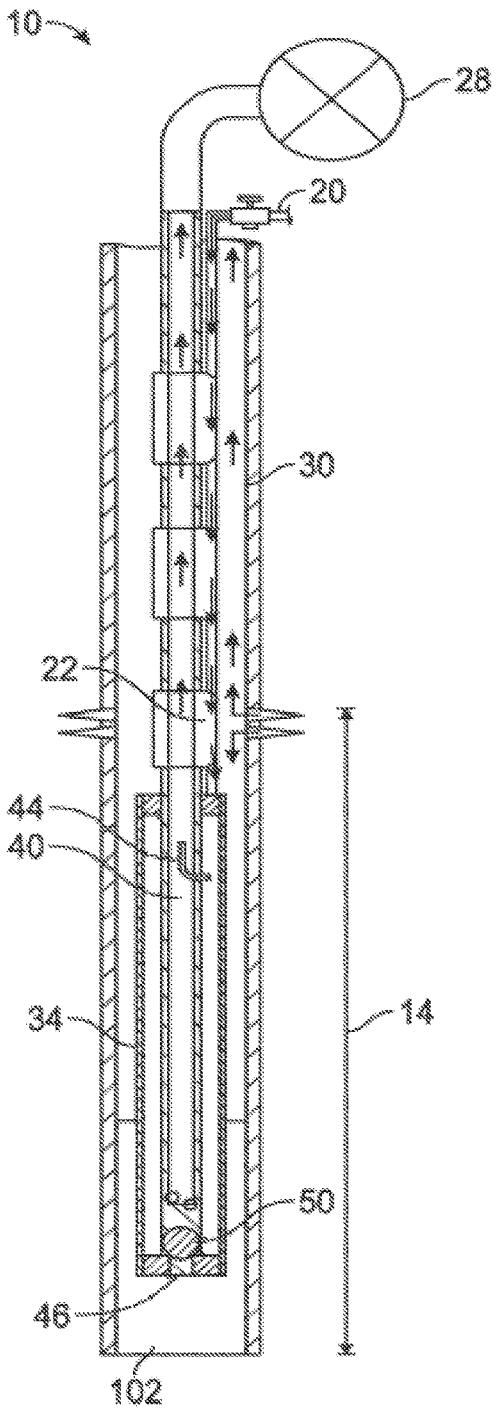
FIG. 3A illustrates an exemplary embodiment of a first configuration of the exemplary apparatus for increasing the production of a gas well as shown in FIG. 1A with several elements omitted for clarity.

With reference to the step 202 of increasing an amount of a liquid within a well bore apparatus, although this step can be performed in various different ways and/or implemented on systems and/or apparatuses of varying configurations, this step will be described in conjunction with FIG. 3A which is an exemplary embodiment of a first configuration of the exemplary apparatus for increasing the production of a gas well as shown in FIG. 1A with several elements omitted for clarity.

For the step 202 of increasing an amount of a liquid within a well bore to be performed, the apparatus 10 can, in one particular embodiment, be initially configured such that the injection valve 20 and chamber valve 22 are in a "closed" position, and the vent valve 44, motor valve 28, and standing valve 46 are in an "open" position. In this particular configuration, the formation can produce gas that can flow into various components of apparatus 10, for example, the casing 30, the lower tubing string 40, etc. As the formation produces gas, any liquids that are not returned to the surface can coalesce near the bottom of the lower portion 14 (for example, in a well annulus 102 proximate to the lower portion crossover 50, or other locations on the lower portion 14, preferably below the lower tubing string perforations 42).

The step 202 of increasing an amount of liquid with a well bore apparatus can include increasing the amount of liquid in the bottle chamber 34 which, in one particular example, can increase if pressure in the casing 30 increases. Based on particular configuration of the valves discussed above, because the standing valve 46 is in the open position, the liquid in the well can freely pass through standing valve 46 into other areas of the lower portion 14. This increased liquid can cause an increase in pressure in the casing 30, thus forcing the liquid into the bottle chamber 34.

As bottle chamber 34 fills with liquid, entrained gas can escape so as to not further increase the pressure of the system. The entrained gas can escape as a result of the pressure differential caused by the increased pressure in the casing 30 as a result of the step 202 of increasing an amount of liquid with a well bore apparatus. In one particular example, the gas can be entrained if an increased pressure in the bottle chamber 34 is detected. In the embodiment shown in FIG. 3A, vent valve 44 can be in its open position and, thus, the entrained gas can escape through the lower tubing string 40 or the casing 30. After passing through the lower tubing string 40 or the casing 30, the entrained gas can escape to the surface 102 so that it may later be used as a separator.

Because lower tubing string 40 can include one or more perforations 42, as the liquid fills into bottle chamber 34 from casing 30 as a result of the step 202 of increasing an amount of liquid within a well bore apparatus, lower tubing string 40 will also fill with liquid because the perforations 42 will allow the bottle chamber 34 and lower tubing string 40 to be in fluid communication with one another. In other words, the liquid, as its amount increases within the apparatus 10, will pass freely from bottle chamber 34 to lower tubing string 40 through the one or more perforations 42.

As the pressure in the bottle chamber 34 increases as a result of the step 202 of increasing an amount of a liquid within the well bore apparatus 10, eventually the pressure in the bottle chamber 34 will exceed the pressure in the casing 30. When this occurs, the step 210 of closing the standing valve can be performed.

The step 210 of closing the standing valve can include closing this valve through a valve actuator, motor, or any other mechanical, electrical, magnetic mechanism for adjusting a valve from an open position to a closed position (and vice-versa). For example, the step 210 of closing the standing valve can include employing the controller 106 to send a signal to close the valve. Once the standing valve 46 is in the closed position, liquid will no longer be able to freely flow into through the standing valve 46 and, thus, the step 202 of increasing an amount of liquid within a well bore apparatus will complete.

Figure 3B:
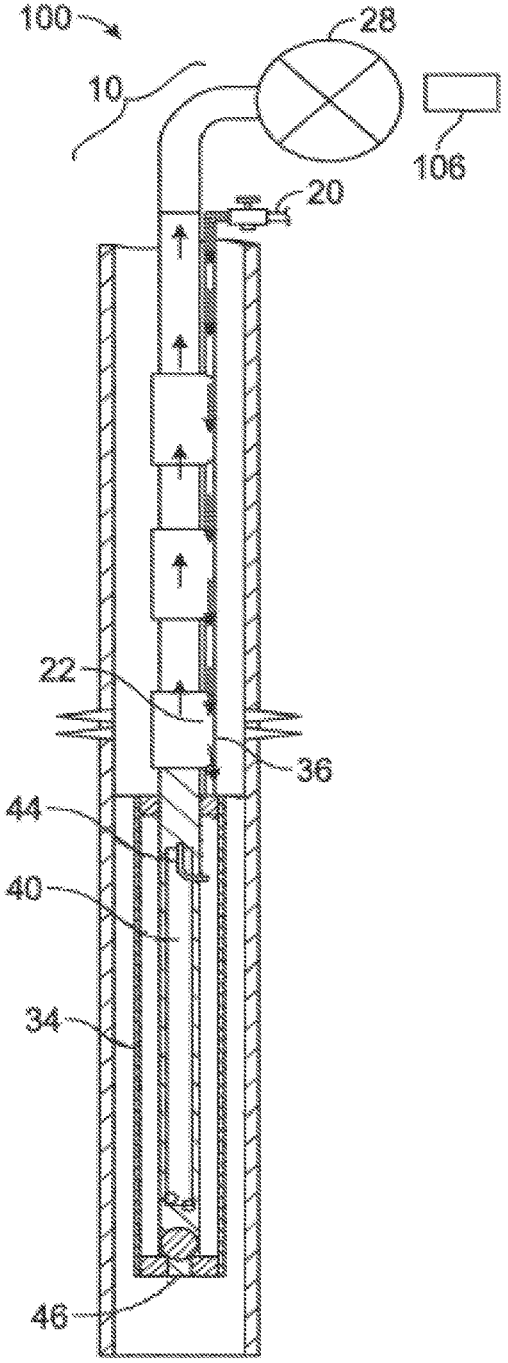
FIG. 3B illustrates an exemplary embodiment of a second configuration of the exemplary apparatus for increasing the production of a gas well as shown in FIG. 1A with several elements omitted for clarity.

With reference to the step 204 of injecting a first gas through an injection valve when the bottle chamber is filled with the liquid, although this step can be performed in various different ways and/or implemented on systems and/or apparatuses of varying configurations, this step will be described in conjunction with FIG. 3B which illustrates an exemplary embodiment of a second configuration of the exemplary apparatus for increasing the production of a gas well as shown in FIG. 1A with several elements omitted for clarity.

With the standing valve 46 in the closed position the process 200 can perform the step 204 of injecting a first gas. In one example, the step 204 of injecting a first gas 204 can be performed in response to a determination that the bottle chamber 34 is filled. For example, a controller 106 can be used in conjunction with pressure gauge 36. In one example, pressure gauge 36 can be disposed at a location just above the one or more lower tubing string perforations 42, although other locations are contemplated as well. In this example, controller 106 can be used to read the measurement taken by pressure gauge 36 to determine whether or not bottle chamber 34 is filled.

In one example, the controller 106 can read the pressure gauge's 36 measurement through the use of a flat pack cable. In other examples, the controller 106 can be omitted and other mechanisms for determining whether or not the bottle chamber 34 is full can be performed (such as, for example, a fill gauge (not shown), a timer, or other instruments can be used to determine and/or generate a signal to indicate that bottle chamber 34 is full).

Once determined that bottle chamber 34 is full (which, as described in greater detail above, can also result in the lower tubing string 40 to become full), the step 204 of injecting a first gas can be performed. In one example, this can include the step 212 of opening the injection valve. Once opened, the injection valve 20 can permit the first gas to pass through it and into the injection conduit 18. As a result, the step 214 of opening the chamber valve can be performed. The chamber valve 22 can be operated in a manner similar to the operation of the standing valve 46 as described above (i.e., operated through an actuator, motor, etc.). Furthermore, the step 214 of opening the chamber valve can be performed such that the as a result of the injection valve 20 being opened (i.e., as the injection valve 20 is opened, the chamber valve 22 can be closed, and vice-versa), or as a result of a pressure differential within the chamber valve 22 vis-à-vis another component of the apparatus 10.

Furthermore, the opening of the injection valve 20 can be performed in conjunction with the aid of a choke (not shown), or other device for fully or partially restricting the flow of fluid through a valve. Once the chamber valve 22 is open, the step 216 of closing a vent valve 44 can be performed. As similarly described in conjunction with the operation of the chamber valve 22, the operation of the vent valve 44 can be performed by the controller 106, or it can be closed based on a pressure differential within the lower tubing string 40 vis-à-vis another component of apparatus 10. In one particular example, the motor valve 28 and the standing valve 46 can remained closed throughout the step 204 of injecting a first gas.

Figure 3C:
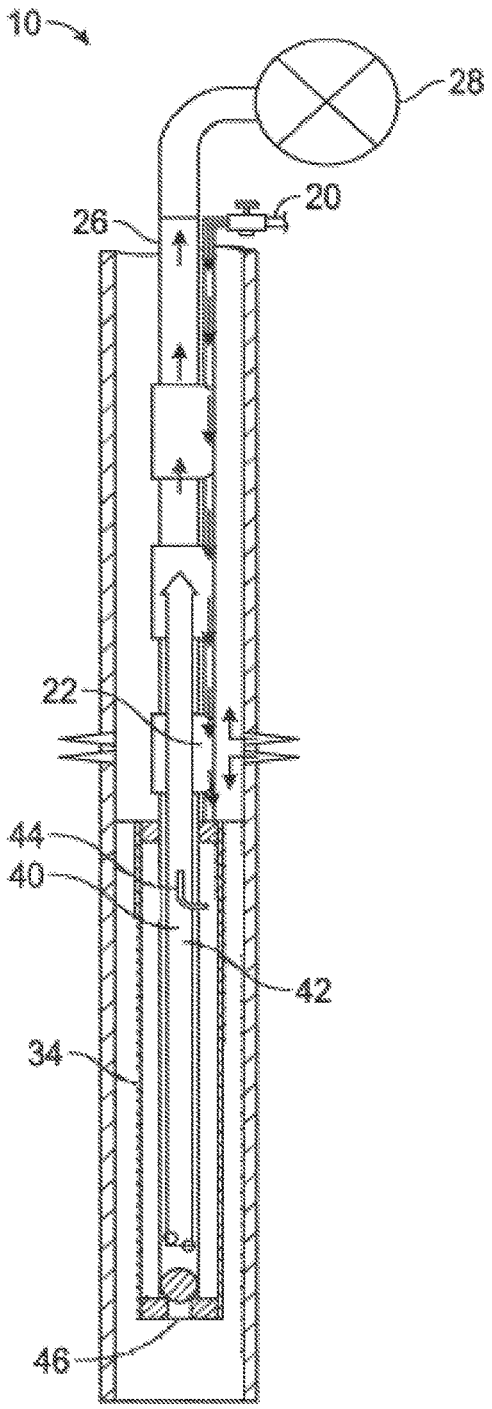
FIG. 3C illustrates an exemplary embodiment of a third configuration of the exemplary apparatus for increasing the production of a gas well as shown in FIG. 1A with several elements omitted for clarity.

With reference to the step 206 of extracting a second gas from the apparatus if a first pressure differential between the casing and the lower tubing string is detected, although this step can be performed in various different ways and/or implemented on systems and/or apparatuses of varying configurations, this step will be described in conjunction with FIG. 3C which illustrates an exemplary embodiment of a third configuration of the exemplary apparatus for increasing the production of a gas well as shown in FIG. FIG. 1A with several elements omitted for clarity.

Once the step 204 of injecting a first gas completes, in one particular configuration, the chamber valve 22 can be opened and the vent valve 44 can be closed. In this configuration, pressure in the bottle chamber 34 can cause its liquid through the one or more lower tubing string 42 perforations and into the lower tubing string 40. As the liquid continues to be pushed through the lower tubing string 40, it can rise upwardly towards the surface and into the upper tubing string 26.

With the motor valve 28 in an open position, gas produced from the formation that has been gathering at the bottom of the apparatus 10 will rise through the lower tubing string 40 and the upper tubing string 26 and finally to the surface where it may enter into a gathering system (not shown). In one example, the second gas can be adapted to flow through the vent valve 44 to the surface. In the particular configuration depicted in FIG. 3C, the standing valve 46 can remain closed until the pressure in the casing 30 exceeds the pressure in the lower tubing string 40.

Figure 3D:
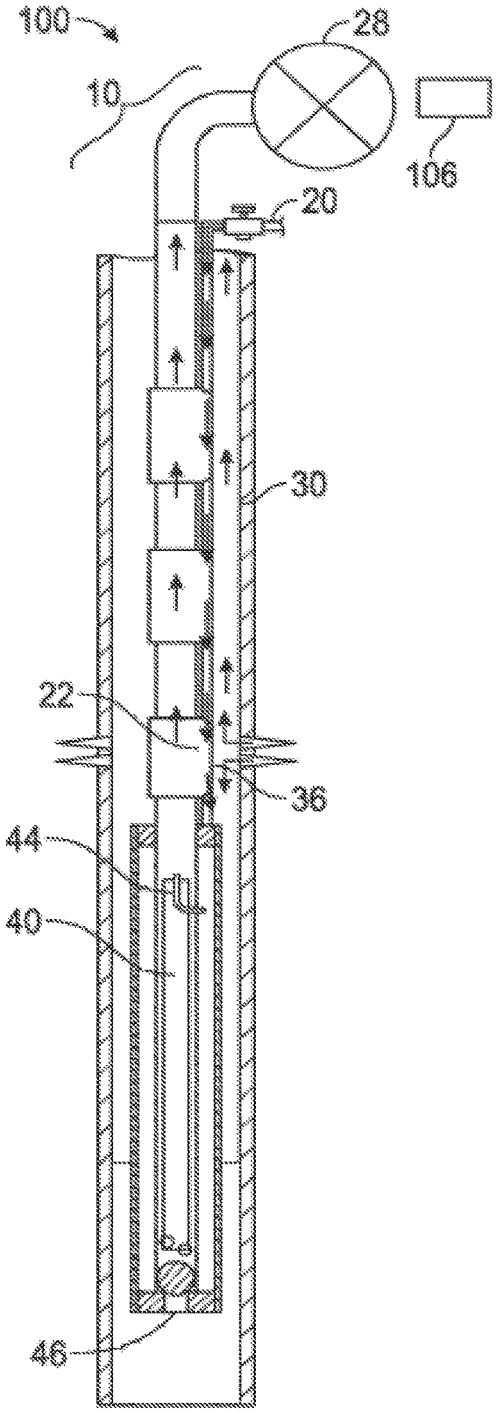
FIG. 3D illustrates an exemplary embodiment of a fourth configuration of the exemplary apparatus for increasing the production of a gas well as shown in FIG. 1A with several elements omitted for clarity.

With reference to the step 208 of closing the injection valve, although this step can be performed in various different ways and/or implemented on systems and/or apparatuses of varying configurations, this step will be described in conjunction with FIG. 3D which illustrates an exemplary embodiment of a fourth configuration of the exemplary apparatus for increasing the production of a gas well as shown FIG. 1A with several elements omitted for clarity.

As the step 206 of extracting a second gas from the apparatus if a first pressure differential between the casing and the lower tubing string is detected is performed, liquid and gas are returned to the surface as described in greater detail above. This step can include the step 218 of extracting the liquid from the apparatus through the lower tubing string. The first pressure differential can include the pressure within the casing 30 as exceeding the pressure within the lower tubing string 40.

As a result of the extracting step 206, the pressure in the lower tubing string 40 will drop relative to the pressure in the casing 30. The change in pressure can be detected in a variety of ways. For example, controller 106 can send and receive one or more transmissions and/or signals at a triggering point depending on the either the absolute pressure in the casing 30 and/or lower tubing string 40, or based on the relative pressure difference between the casing 30 and/or the lower tubing string 40. This can be accomplished, for example, through the aid of the pressure gauge 36. More generally, other examples described above with reference to detecting pressure and/or pressure differentials can be employed as well.

After this change in pressure is detected, the step 208 of closing the injection valve can be performed. Again, the injection valve 20 can be switched from the open to the closed position in a variety of ways (e.g., through a motor, an actuator, etc.) as described above. Once the injection valve is closed, the flow of a first gas through the injection conduit can terminate. Furthermore, as the liquid is removed from the apparatus 10 from the step 206 of extracting a second gas, the step 220 of opening the standing valve if a first pressure differential between the casing and the lower tubing string is detected can be performed.

Once this step is performed, the pressure in the casing 30 will be less than the pressure in the lower tubing string 40. With this pressure differential, the step 222 of closing the chamber valve can be performed. The operation of the chamber valve 22 (i.e., from the open to the closed position) can be performed in accordance with any of the other mechanism used to operate other valves as set forth throughout this disclosure as described above. With the injection valve 20 and chamber valve 22 closed; and the vent valve 44, motor valve 28, and standing valve 46 open, the process can be repeated by returning to the step 202 of increasing an amount of liquid within a well bore apparatus.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Discussion of singular elements can include plural elements and vice-versa.

In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved. For example, FIG. 2 illustrates one possible embodiment of a method. More specifically, as presently disclosed in FIG. 2, the step 210 of closing a standing valve occurs after the step 208 of closing the injection valve. In other embodiments, the step 210 can occur before the step 208. In other embodiments, some steps can be omitted altogether. Therefore, though not explicitly illustrated in the Figures, any and all combinations or sub-combinations of the steps illustrated in FIG. 2, or additional steps described in the Figures or the detailed description provided herein, can be performed in any order, with or without regard for performing the other recited steps.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range or equivalent of the following claims.

What is claimed is:

1. An apparatus for increasing the production of gaseous hydrocarbons to the surface from a well in which the gaseous hydrocarbons pass from a geologic formation into the well through casing perforations, the apparatus comprising:

a bottle chamber, wherein the bottle chamber is positioned below the casing perforations and wherein the bottle chamber comprises:

a lower tubing string inside the bottle chamber, wherein the lower tubing string includes chamber perforations that place the lower tubing string in communication with fluid inside the bottle chamber;

a standing valve configured to permit the one-way passage of liquid into the lower tubing string;

an injection conduit connected between a source of pressurized gas and the top of the bottle chamber; and an upper tubing string connected between the lower tubing string and facilities located on the surface.

2. A method for unloading liquid to the surface from a subterranean well in which liquids and gaseous hydrocarbons pass from a geologic formation into the well through casing perforations, the method comprising the steps of:

connecting a tubing string to a bottle chamber, wherein the bottle chamber includes a one-way valve that permits fluid to enter the bottle chamber;

connecting an injection conduit between a source of pressurized gas and the bottle chamber;

placing the tubing string, injection conduit and bottle chamber in the well such that the bottle chamber is positioned below the casing perforations and the tubing string and injection conduit extend from the bottle chamber to the surface;

allowing liquid to accumulate within the bottle chamber; and injecting pressurized gas into the bottle chamber to displace the accumulated liquid, wherein the displaced accumulated liquid is pushed to the surface through the tubing string.

3. The method of claim 2, further comprising the step of detecting the liquid level in the bottle chamber before the step of injecting pressurized gas into the bottle chamber, wherein the step of injecting pressurized gas into the bottle chamber further comprises injecting pressurized gas into the bottle chamber in response to the detection that the liquid level in the bottle chamber has reached a predetermined threshold level.

* * * * *